US011851243B1

(12) United States Patent
Quigley

(10) Patent No.: US 11,851,243 B1
(45) Date of Patent: Dec. 26, 2023

(54) FOOD STORAGE BAG

(71) Applicant: 3GreenMoms LLC, Bethesda, MD (US)

(72) Inventor: Kirsten Quigley, Potomac, MD (US)

(73) Assignee: 3GREENMOMS, BENEFIT LLC, Potomac, MD (US)

( * ) Notice: Subject to any disclaimer, the term of this patent is extended or adjusted under 35 U.S.C. 154(b) by 62 days.

(21) Appl. No.: 15/898,205

(22) Filed: Feb. 15, 2018

Related U.S. Application Data

(60) Provisional application No. 62/459,425, filed on Feb. 15, 2017.

(51) Int. Cl.

| | |
|---|---|
| ***B65D 30/08*** | (2006.01) |
| ***B65D 33/20*** | (2006.01) |
| ***B65D 33/00*** | (2006.01) |
| ***B65D 30/20*** | (2006.01) |

(52) U.S. Cl.
CPC ..... *B65D 33/20* (2013.01); *B65D 31/10* (2013.01); *B65D 33/004* (2013.01)

(58) Field of Classification Search
CPC ..... B65D 33/20; B65D 33/004; B65D 33/18; B65D 33/1691; B65D 31/10; B65D 27/16; B65D 27/14
USPC ..... 229/80.5, 67.4, 80, 68.1; 383/120
See application file for complete search history.

(56) References Cited

U.S. PATENT DOCUMENTS

| | | | | |
|---|---|---|---|---|
| 768,340 | A * | 8/1904 | Ormsbee | B65D 27/00 229/68.1 |
| 3,070,280 | A | 12/1962 | Richmond | |
| 3,245,607 | A * | 4/1966 | Kelson | A61L 2/26 116/207 |
| 3,608,815 | A * | 9/1971 | Bunch | B65D 75/5805 383/201 |
| 4,876,125 | A * | 10/1989 | Akao | B65D 31/02 428/35.2 |
| 5,429,576 | A * | 7/1995 | Doderer-Winkler | B31B 70/00 156/517 |
| D541,667 | S | 5/2007 | Pokusa et al. | |
| 2004/0120611 | A1* | 6/2004 | Kannankeril | B65D 31/10 383/110 |
| 2005/0031233 | A1* | 2/2005 | Varanese | B65D 33/20 383/211 |
| 2006/0066096 | A1* | 3/2006 | Kan | B65D 33/20 283/101 |
| 2013/0084374 | A1 | 4/2013 | Budday | |
| 2014/0072247 | A1* | 3/2014 | McDonough | B65D 75/008 383/210.1 |

(Continued)

OTHER PUBLICATIONS envelopes.com, "A2 (4⅜×5¾)—Clear Translucent", https://www.envelopes.com/envelopes/control/product/~category_id=SQUARE_FLAP/~product_id=4870-00, date unknown.

(Continued)

*Primary Examiner* — Robert Poon

(74) *Attorney, Agent, or Firm* — Oliver Edwards; Law Office of Oliver Edwards LLC

(57) ABSTRACT

An environmentally friendly food storage bag is disclosed. The bag may include a closing flap that can be secured by means of an adhesive strip which is exposed upon removal of a protective strip. The bag may be unsealed and resealed, permitting multiple uses. The bag may be disposed in the paper recycling stream or may be composted.

2 Claims, 4 Drawing Sheets

(56) References Cited

U.S. PATENT DOCUMENTS

| | | | |
|---|---|---|---|
| 2014/0251849 | A1 | 9/2014 | Huffer |
| 2015/0266622 | A1 | 9/2015 | Tseng et al. |

OTHER PUBLICATIONS

Glassine USA, "The Glassine Web-Shop / Medical Blue Glassines / End Open", http://home.onemain.com/~gpg/custom_designs.htm, date unknown.

* cited by examiner

FOOD STORAGE BAG

BACKGROUND

Field of the Invention

The present invention relates to single use and resealable food storage bags that are environmentally friendly in the waste stream.

Description of the Related Art

Food products must be protected against contamination and many products must be protected from oxygen exposure and must be prevented from either drying out (in the case of moist products such as cheese) or from picking up moisture from the outside environment (in the case of dry products such as sandwiches, crackers or cookies). One common and inexpensive form of storage is the plastic food storage bag for keeping food fresh for a desired period of time. These plastic storage bags are beneficial to keeping food fresh, as well as for allowing food to be transported from one place to another without spilling, leakage, or contamination.

However, one problem with plastic food storage bags is their harmful effect on the environment as most are disposed of after one use and not recycled. Each day, 20 million plastic food storage bags end up in landfills or go directly into waterways. Fish and other marine life may eat plastic food storage bag debris that ends up in the waterways, which leads to irritation or damage to their digestive system or death. Plastic food storage bag debris wreaks havoc on wildlife, pollutes beaches, and enters our food chain.

Plastic food storage bags are typically made from polyethylene plastic, a plastic that is estimated to take over 200 to 1,000 years to decompose in a landfill. Plastic food storage bags do not biodegrade; instead, some, if exposed to the sun, photodegrade into smaller and smaller toxic bits that can contaminate soil and waterways. Additionally, recycling of plastic food storage bags is expensive and tends to produce low-quality plastic output.

In addition to these plastic food storage bags, plastic storage containers, such as Tupperware® containers are also available to store and transport food. These plastic containers may be reused and washed; however, these plastic food containers tend to be bulky, inflexible, and more expensive when compared to plastic food storage bags and do not offer the same ease of use and flexibility.

In response to these problems with plastic food storage bags and plastic storage containers and in accordance with the present invention, storage bags have been made from materials that are environmentally friendly in the waste stream. The present invention provides such a sealable food storage bag that is made of food-safe and food-proof material that is recyclable as well as readily degradable in the waste stream and that provides a flexible, environmentally "green" option for food storage.

This disclosure is especially concerned with such packages for perishable products, wherein the packages include a sealing feature and are reclosable after the initial opening.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
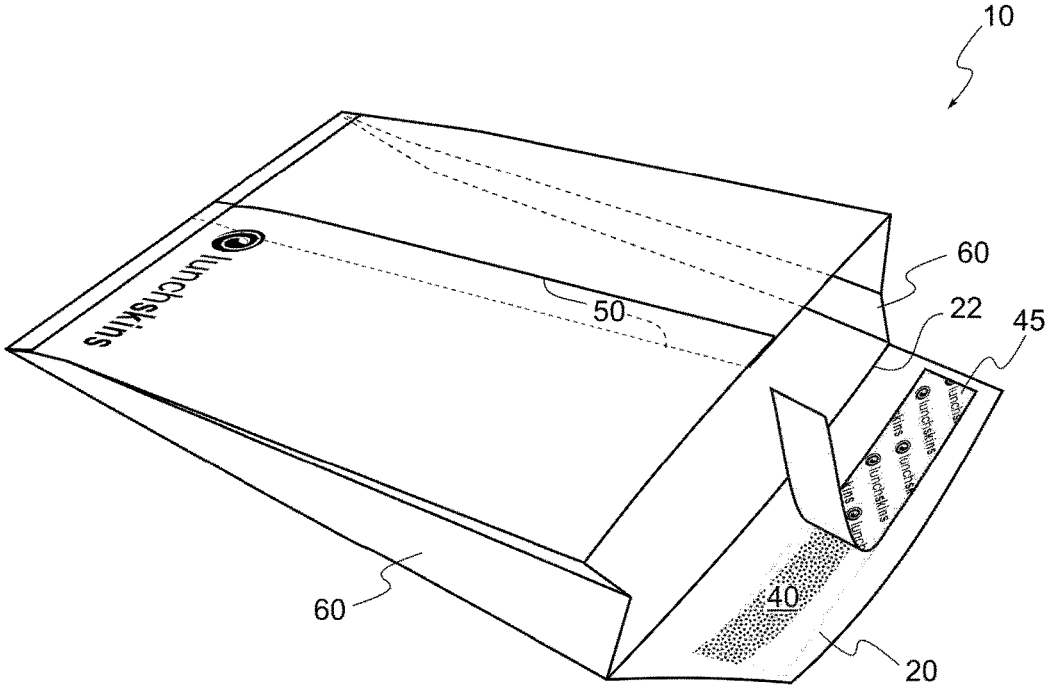
FIG. 1 is a perspective view illustration of an exemplary embodiment of the present invention.
Figure 3:
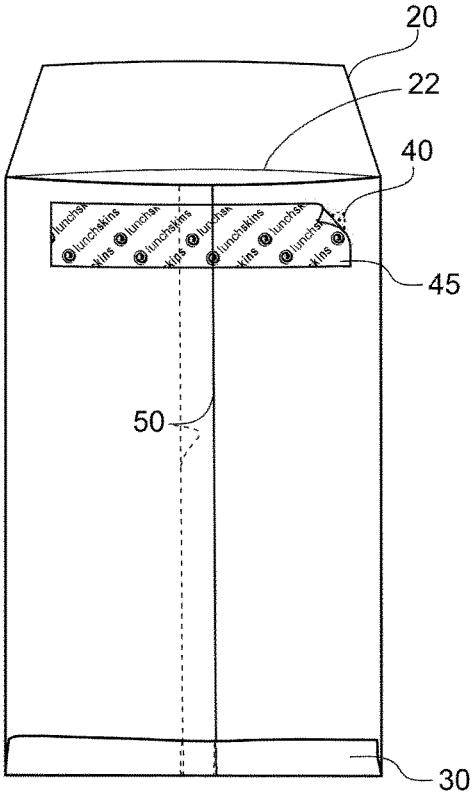
FIGS. 3-4 illustrate exemplary embodiments of the present invention.
Figure 4:
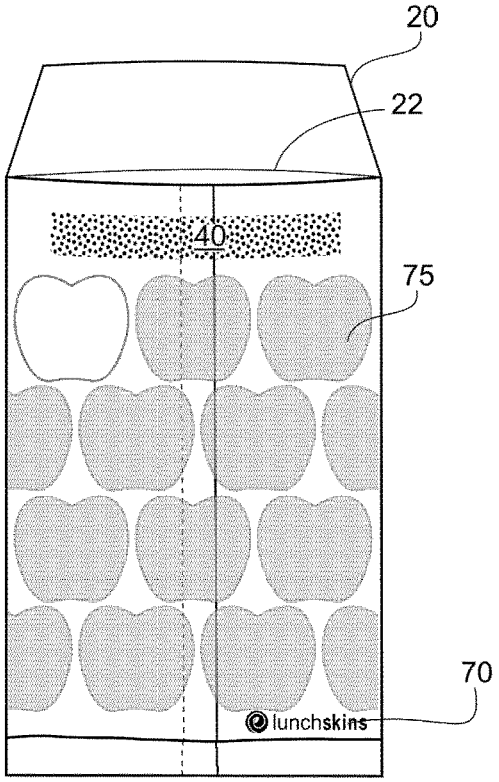

With referenced to FIG. 1, a bag 10 in accordance with the present invention may comprise a recyclable and compostable glassine pouch. The pouch has a top opening through which foods and consumables (such sandwich 41, crackers, cookies, nuts, snack foods, etc., not shown) may be inserted for short-term storage. Bag 10 may include fold-over flap 20 on the top. In one embodiment, flap 20 features an adhesive strip 40 thereon, protected with peel-away strip 45 (shown half-way peeled-up in FIGS. 1 and 6, and with a corner peeled-up in FIG. 3). With reference to FIGS. 3 and 4, in other embodiments, adhesive strip 40 may be on the front of bag 10 so that the fold-over flap 20 comes into contact with adhesive strip 40 when bag 10 is closed. Bags in accordance with the present invention may also bear designs such as design 75 and/or logo or trademarks such as mark 70 printed on the exterior of the glassine sleeve using food-safe inks. In some embodiments, design 75 is an aesthetic design to appeal to the target user group demographic. For example, design 75 might comprise apples as illustrated in FIG. 4 or sharks as illustrated in FIGS. 6-8.

Once food or the like is inserted into bag 10, peel-away strip 45 is removed, exposing adhesive strip 40 and flap 20 is folded over fold line 22, closing the top of bag 10, and flap 20 is pressed and attached to the front exterior surface to seal bag 10.

Figure 2:
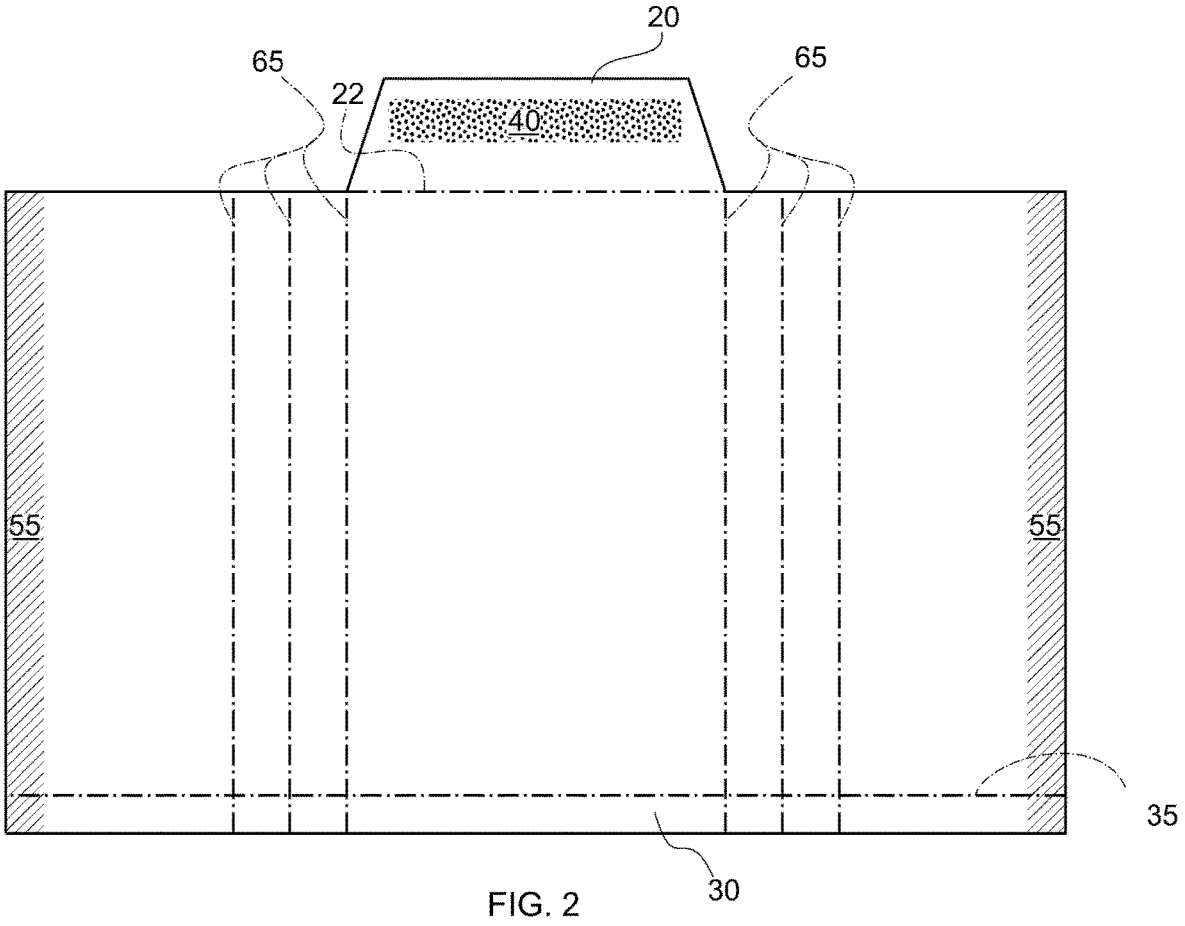
FIG. 2 is an illustrative pre-assembly view in accordance with an exemplary embodiment of the present invention.
Figure 6:
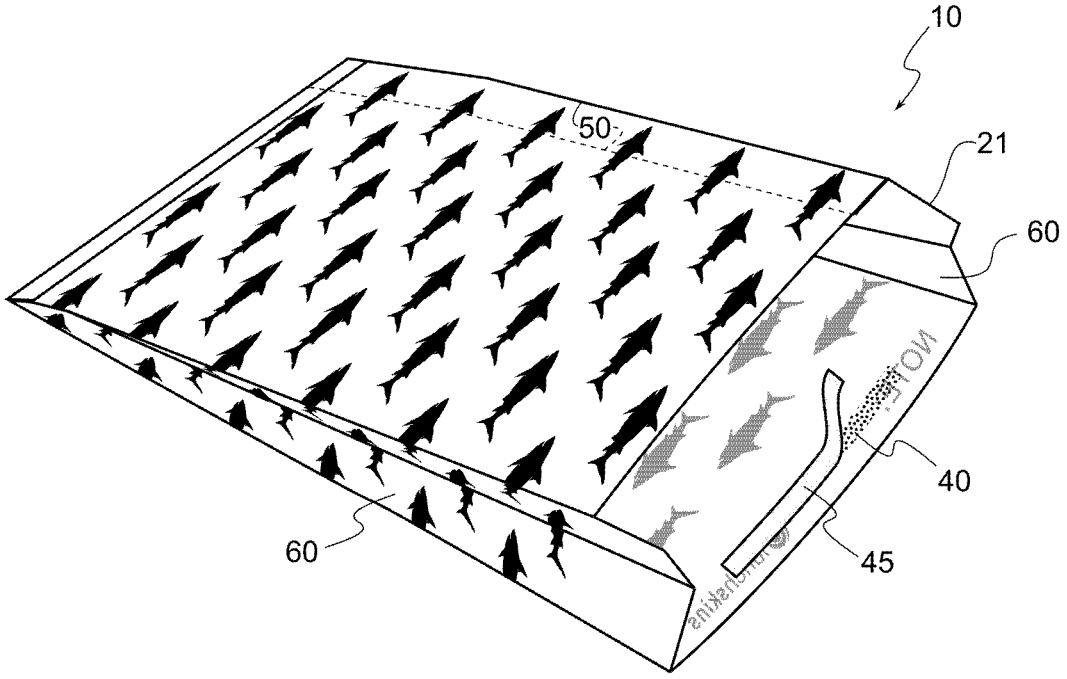
FIG. 6 is a perspective view illustration of an exemplary embodiment of the present invention.
Figure 7:
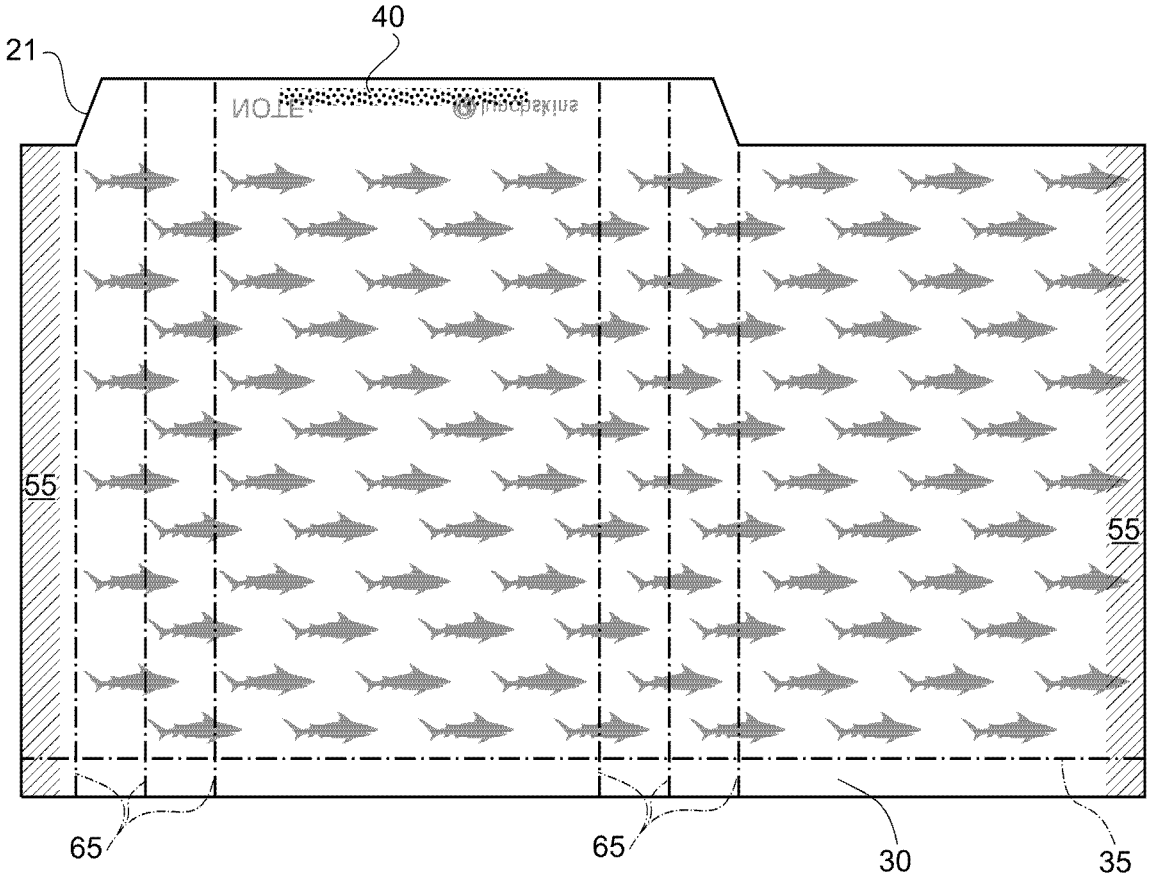
FIG. 7 is an illustrative pre-assembly view in accordance with an exemplary embodiment of the present invention.
Figure 8:
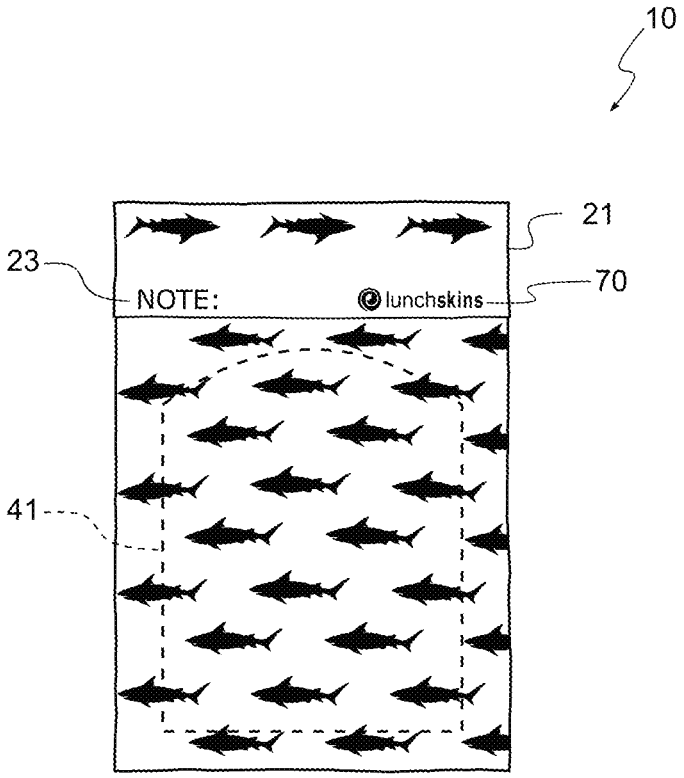
FIG. 8 is a front view illustration of an exemplary embodiment of the present invention in a closed configuration.

With reference to the embodiment illustrated in FIGS. 6-8, bag 10 may comprise a foldover tab 21 that extends from the back and pleats 60 of bag 10 and may taper to the top edge of the front of bag 10. In this embodiment there may be enhanced side-edge security for the bag contents compared to that of the FIG. 2 embodiment (in which flap 20 is folded at foldover line 22). In the FIGS. 6-8 embodiment, adhesive strip 40 may not extend into the margins so as not to come into contact with the folds of pleat 60. In some embodiments, a labeled NOTE area 23 is provided for hand writing a note such as a name, identification of contents, identification of date packed, or other notation. The embodiment of FIGS. 6-8 may be closed by squeezing closed pleats 60 to flatten and crease bag 10 at the open, top end, the creasing and folding so that adhesive strip 40 adheres to the front of bag 10 as illustrated in FIG. 8.

Glassine is a translucent supercalendared paper product generally resistant to air and oils and somewhat resistant to water. In accordance with some embodiments of the present invention, undyed and/or unbleached glassine may be used. Glassine weights compatible with the present invention include weights in the 24 lb to 55 lb range. In accordance with some embodiments of the present invention, unwaxed glassine is used in order to promote decomposition of a used bag in, for example, a composting bin. Glassine, being a paper product, is also generally recyclable with other paper products.

Figure 5:
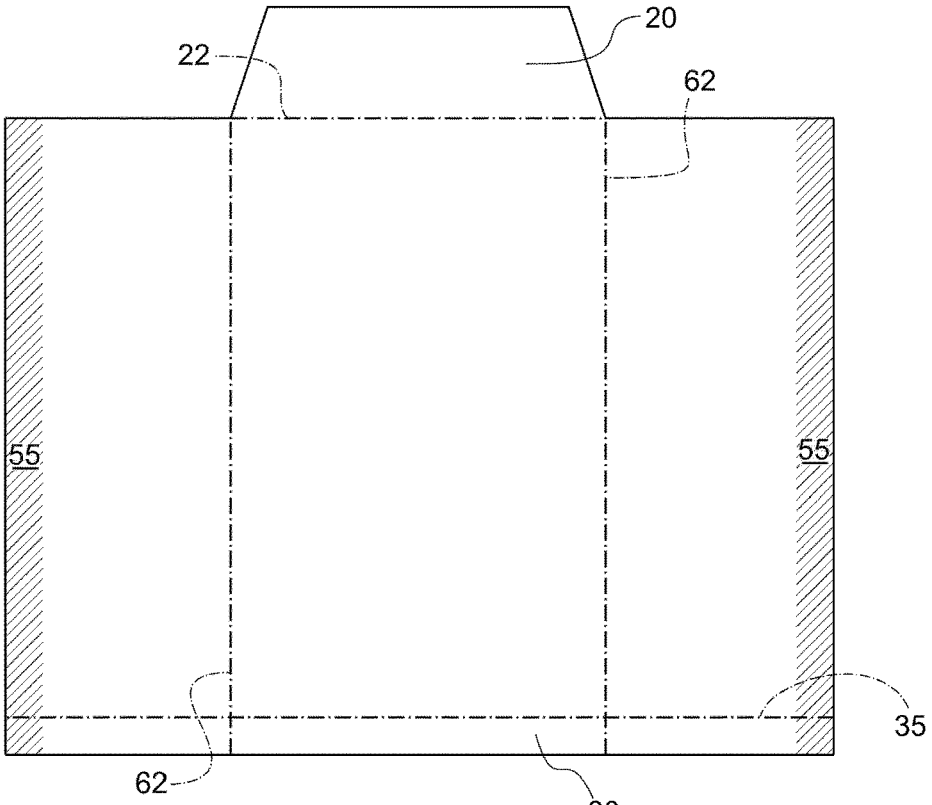
FIG. 5 is an illustrative pre-assembly view in accordance with an exemplary embodiment of the present invention.

Bags in accordance with the present invention may be formed from a single sheet of glassine cut and folded as is known in the art. For example, with reference to FIGS. 2, 5 and 7, a single sheet of glassine cut as shown may be longitudinally folded along fold lines 62 or 65, gluing regions 55 to form seam 50, thereby forming a sleeve open at top and bottom. Then, the bottom seam 30 may be formed by folding along fold line 35 and gluing. Bags in accordance with the present invention may optionally have expanding pleats such as side pleats 60 illustrated in FIGS. 1 and 6. A bottom pleat (not shown) can be used in an alternative embodiment in addition to or instead of side pleats.

Adhesive strip 40 is composed of a food-safe, non-toxic preferably compostable adhesive. The adhesive may comprise a water-based, food grade, thin-film hot melt glue. In some embodiments, adhesive strip 40 is of a sufficiently persisting tackiness to permit multiple sealings and unsealings of bag 10, thereby permitting multiple uses of a bag.

Peel-away strip 45 is not substantially permeable to the adhesive and is generally lightly adherable to the adhesive so that it can be peeled away without removing adhesive strip 40 from bag 10. Peel-away strip 45 may comprise non-recyclable and non-compostable materials in which case strips 40 and 45 are dimensionally optimized to produce the smallest amount of non-recyclable or non-compostable waste from strip 45 and still provide a sufficiently securing adhesion area for closure of bag 10.

Bags in accordance with the present invention provide easy, affordable food storage solutions that are recyclable or compostable alternatives to single-use plastic sandwich and snack bags. Because of the food-safe and compostable composition of the bags, it is possible to toss them into a compost bin and later use the compost in, for example, a vegetable garden.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

It should be emphasized that the above-described embodiments of the present disclosure are merely possible examples of implementations set forth for a clear understanding of the principles of the disclosure. Many variations and modifications may be made to the above-described embodiments without departing substantially from the spirit and principles of the disclosure. All such modifications and variations are intended to be included herein within the scope of this disclosure and protected by the patent's claims.

What is claimed is:

1. A food storage bag comprising:

a pouch formed of glassine comprising an open top end, a front side and a back side, wherein the pouch defines an open space for placing a food item within;

a flap extending from the back side at the top end of the pouch, wherein the flap is configured to fold over the open top end and contact an area of the front side of the pouch, thereby closing the pouch;

an adhesive strip disposed on the flap whereby the adhesive attaches the flap to the front side of the pouch when the flap is folded-over; and a peel-away strip disposed on the adhesive strip, whereby the peel-away strip prevents adhesion of the adhesive strip until the peel-away strip is peeled away;

wherein the glassine is unbleached and unwaxed.

2. A food storage bag comprising:

a pouch formed of glassine comprising an open top end, a front side and a back side, wherein the pouch defines an open space for placing a food item within;

a flap extending from the back side at the top end of the pouch, wherein the flap is configured to fold over the open top end and contact an area of the front side of the pouch, thereby closing the pouch;

an adhesive strip disposed on the flap whereby the adhesive attaches the flap to the front side of the pouch when the flap is folded-over; and a peel-away strip disposed on the adhesive strip, whereby the peel-away strip prevents adhesion of the adhesive strip until the peel-away strip is peeled away;

wherein the glassine is unbleached and unwaxed, and wherein said area of the front side of the pouch does not have an adhesive strip.

* * * * *